US009795841B2

(12) United States Patent
Ueda et al.

(10) Patent No.: US 9,795,841 B2
(45) **Date of Patent: *Oct. 24, 2017**

(54) GOLF CLUB

(71) Applicant: DUNLOP SPORTS CO. LTD., Kobe-shi, Hyogo (JP)

(72) Inventors: Naoyoshi Ueda, Kobe (JP); Masahiko Ueda, Kobe (JP); Yasushi Sugimoto, Kobe (JP); Takashi Nakamura, Kobe (JP); Seiji Hayase, Kobe (JP); Wataru Kimizuka, Kobe (JP)

(73) Assignee: DUNLOP SPORTS CO. LTD., Kobe-shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/849,148

(22) Filed: Sep. 9, 2015

(65) Prior Publication Data

US 2016/0067567 A1 Mar. 10, 2016

(30) Foreign Application Priority Data

Sep. 10, 2014 (JP) ..... 2014-184691

(51) Int. Cl.
*A63B 53/00* (2015.01)
*A63B 53/10* (2015.01)
(Continued)

(52) U.S. Cl.
CPC ..... *A63B 53/0466* (2013.01); *A63B 53/00* (2013.01); *A63B 53/14* (2013.01);
(Continued)

(58) Field of Classification Search
CPC ..... A63B 53/14; A63B 53/0466; A63B 53/00; A63B 53/10; A63B 60/02; A63B 60/42
See application file for complete search history.

(56) References Cited

U.S. PATENT DOCUMENTS 7,326,125 B2 * 2/2008 Moriyama ..... A63B 53/00 473/292
8,328,656 B2 * 12/2012 Rice ..... A63B 53/10 473/292
(Continued)

FOREIGN PATENT DOCUMENTS

JP 2004-18217 A 7/2004
JP 2004-201911 A 7/2004
(Continued)

*Primary Examiner* — Stephen Blau
(74) *Attorney, Agent, or Firm* — Birch, Stewart, Kolasch & Birch, LLP

(57) ABSTRACT

A golf club 2 includes a head 4, a shaft 6, and a grip 8. A club inertia moment about a swing axis is defined as Isw. A club inertia moment about a grip end is defined as Ige. Ige is 2920 (kg·cm$^2$) or greater and less than 2970 (kg·cm$^2$). Isw/Ige is equal to or less than 2.48. A club weight is defined as Wc (kg), an axial direction distance from the grip end to a center of gravity of the club is defined as Lc (cm), and a club inertia moment about the center of gravity of the club is defined as Ic (kg·cm$^2$). Isw is calculated by Equation (1) below. Ige is calculated by Equation (2) below.

$$Isw=Wc\times(Lc+60)^2+Ic \quad (1)$$

$$Ige=Wc\times(Lc)^2+Ic \quad (2)$$

6 Claims, 9 Drawing Sheets

(51) Int. Cl.

| | |
|---|---|
| ***A63B 53/04*** | (2015.01) |
| ***A63B 53/14*** | (2015.01) |
| ***A63B 60/42*** | (2015.01) |
| *A63B 60/02* | (2015.01) |

(52) U.S. Cl.
CPC ..... *A63B 60/42* (2015.10); *A63B 53/10* (2013.01); *A63B 60/02* (2015.10)

(56) References Cited

U.S. PATENT DOCUMENTS

| | | | | |
|---|---|---|---|---|
| 8,597,134 | B2 * | 12/2013 | Naruo | A63B 53/00 473/282 |
| 8,715,101 | B2 * | 5/2014 | Naruo | A63B 53/047 473/292 |
| 2004/0192462 | A1 * | 9/2004 | Ashida | A63B 53/10 473/319 |
| 2013/0095945 | A1 * | 4/2013 | Nakamura | A63B 53/00 473/292 |
| 2014/0155190 | A1 | 6/2014 | Nakamura | |
| 2015/0018114 | A1 * | 1/2015 | Stokke | A63B 53/10 473/287 |
| 2015/0087435 | A1 | 3/2015 | Nakamura | |

FOREIGN PATENT DOCUMENTS

| | | | | |
|---|---|---|---|---|
| JP | 2006312013 | | * | 11/2006 |
| JP | 2006312013 | A | * | 11/2006 |
| JP | 2007029701 | A | * | 2/2007 |
| JP | 2007136067 | A | * | 6/2007 |
| JP | 2014-131624 | A | | 7/2014 |
| JP | 5546673 | B1 | | 7/2014 |

* cited by examiner

GOLF CLUB

The present application claims priority on Patent Application No. 2014-184691 filed in Japan on Sep. 10, 2014, the entire contents of which are hereby incorporated by reference.

BACKGROUND OF THE INVENTION

Field of the Invention

The present invention relates to a golf club.

Description of the Related Art

It is a flight distance that is an important item to evaluate a golf club.

Japanese Patent Application Laid-Open No. 2004-201911 discloses a wood club in which the mass ratio of a head occupied in the total mass of the golf club is 73% or greater and 81% or less. The kinetic energy of the head can be increased due to a large mass of the head. The initial velocity of a ball can be increased due to the collision against the head having a large kinetic energy. In Japanese Patent Publication No. 5546673 (US2015/0087435), the concept of a moment of inertia about a swing axis is introduced. The concept can contribute to an improvement in a flight distance performance.

SUMMARY OF THE INVENTION

The moment of inertia about the swing axis is considered, and thereby the ease of a swing can be improved while a head weight can be increased. Demand for an increase in a flight distance has more and more increased. The present invention enables a further increase in a flight distance based on new technical ideas.

It is an object of the present invention to provide a golf club excellent in a flight distance performance.

A golf club according to a preferred aspect of the present invention includes a head, a shaft, and a grip. A club inertia moment about a swing axis is defined as Isw (kg·cm$^2$). A club inertia moment about a grip end is defined as Ige (kg·cm$^2$). Preferably, the inertia moment Ige is 2920 (kg·cm$^2$) or greater and less than 2970 (kg·cm$^2$). Preferably, Isw/Ige is equal to or less than 2.48.

A club weight is defined as Wc (kg), an axial direction distance from the grip end to a center of gravity of the club is defined as Lc (cm), and a club inertia moment about the center of gravity of the club is defined as Ic (kg·cm$^2$). The inertia moment Isw (kg·cm$^2$) is calculated by Equation (1) below. The inertia moment Ige (kg·cm$^2$) is calculated by Equation (2) below.

$$Isw=Wc\times(Lc+60)^2+Ic \quad (1)$$

$$Ige=Wc\times(Lc)^2+Ic \quad (2)$$

Preferably, a grip weight Wg is equal to or less than 0.037 kg.

Preferably, a head weight Wh is equal to or greater than 0.202 kg.

Preferably, Wh/Wc is equal to or greater than 0.66.

DESCRIPTION OF THE PREFERRED EMBODIMENTS

In the following, the present invention will be described in detail based on preferred embodiments with appropriate reference to the drawings.

It is noted that in the present application, the term "axial direction" means the axial direction of a shaft.

Figure 1:
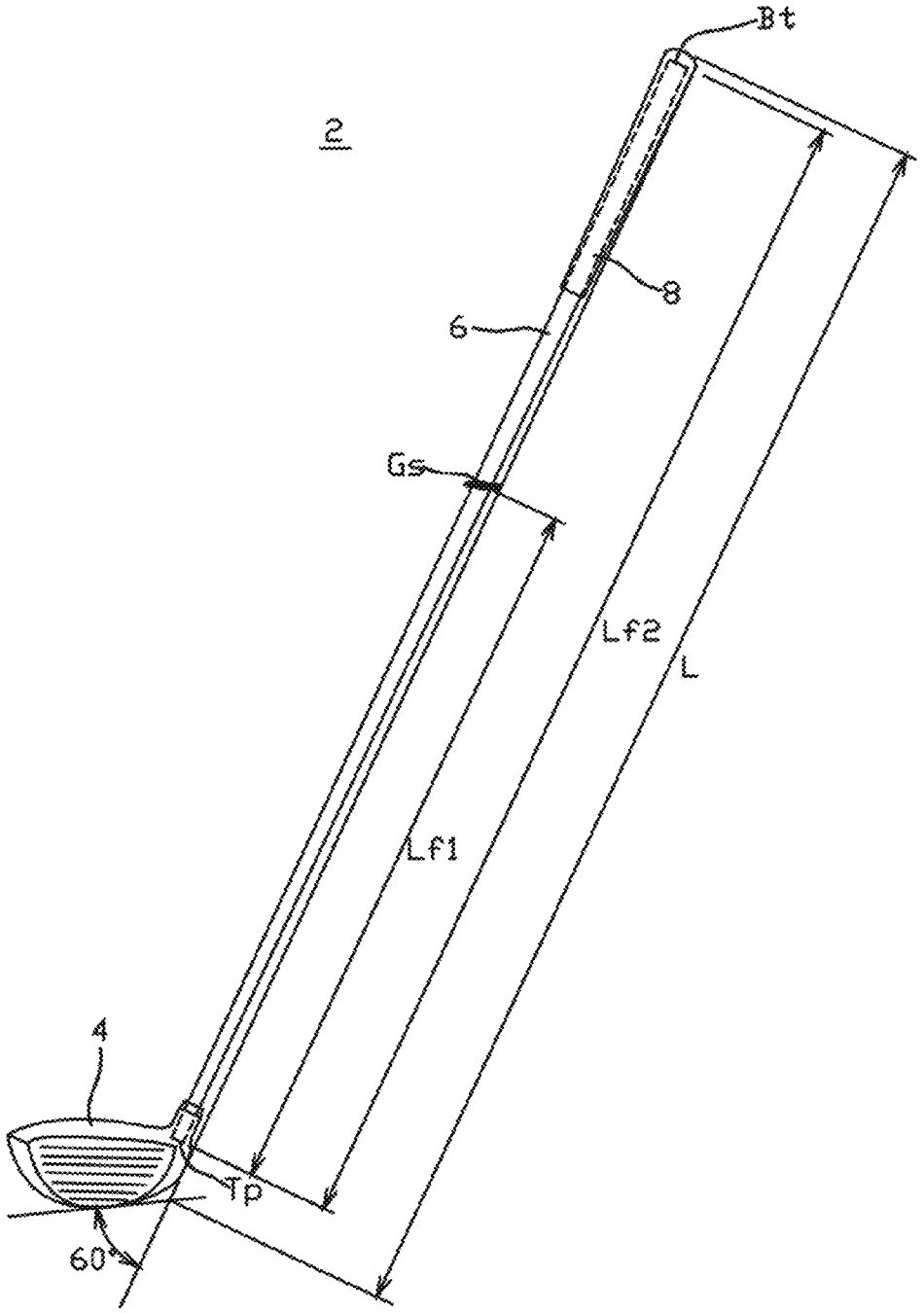
FIG. 1 shows a golf club according to an embodiment.

FIG. 1 shows a golf club 2 according to one embodiment of the present invention. A golf club 2 includes a head 4, a shaft 6, and a grip 8. The head 4 is mounted on the tip end part of the shaft 6. The grip 8 is mounted on the butt end part of the shaft 6. The head 4 has a hollow structure. The head 4 is a wood type. The golf club 2 is a driver (a number 1 wood).

The golf club 2 has an excellent flight distance performance. The golf club 2 is a driver (a number 1 wood). Preferably, a club length is equal to or greater than 43 inches. Preferably, the golf club 2 is a wood type golf club. Preferably, the head 4 is a wood type golf club head.

The shaft 6 is formed of a laminate of fiber reinforced resin layers. The shaft 6 is a tubular body. The shaft 6 has a hollow structure. As shown in FIG. 1, the shaft 6 includes a tip end Tp and a butt end Bt. The tip end Tp is located in the head 4. The butt end Bt is located in the grip 8.

In FIG. 1, a two-directional arrow Lf2 expresses a shaft length. The shaft length Lf2 is an axial direction distance between the tip end Tp and the butt end Bt. In FIG. 1, a two-directional arrow Lf1 expresses an axial direction distance from the tip end Tp to the center of gravity Gs of a shaft. The center of gravity Gs of the shaft is the center of gravity of the shaft 6 alone. The center of gravity Gs is located on the shaft axis. In FIG. 1, a two-directional arrow L expresses the club length. A measurement method for the club length L will be described later.

The shaft 6 is a so-called carbon shaft. Preferably, the shaft 6 is formed by curing prepreg sheets. In the prepreg sheet, fibers are aligned substantially in one direction. The prepreg in which fibers are aligned substantially in one direction is also referred to as a UD prepreg. "UD" stands for uni-direction. A prepreg other than the UD prepreg may be used. For example, the prepreg sheet may include woven fiber.

The prepreg sheet includes fiber and a resin. The resin is also referred to as a matrix resin. Typically, the fiber is carbon fiber. Typically, the matrix resin is a thermosetting resin.

The shaft 6 is manufactured by a so-called sheet winding method. In the prepreg, the matrix resin is in a semi-cured state. The shaft 6 is formed by winding and curing prepreg sheets.

The matrix resin used for the prepreg sheet can be an epoxy resin, or a thermosetting resin or thermoplastic resin other than an epoxy resin. From the viewpoint of shaft strength, an epoxy resin is preferably used as the matrix resin.

The method for manufacturing the shaft 6 is not limited. From the viewpoint of weight reduction and the degree of freedom for design, a shaft manufactured by a sheet winding method is preferable. The material of the shaft 6 is not limited. The shaft 6 may be a metal shaft, for example.

Figure 2:
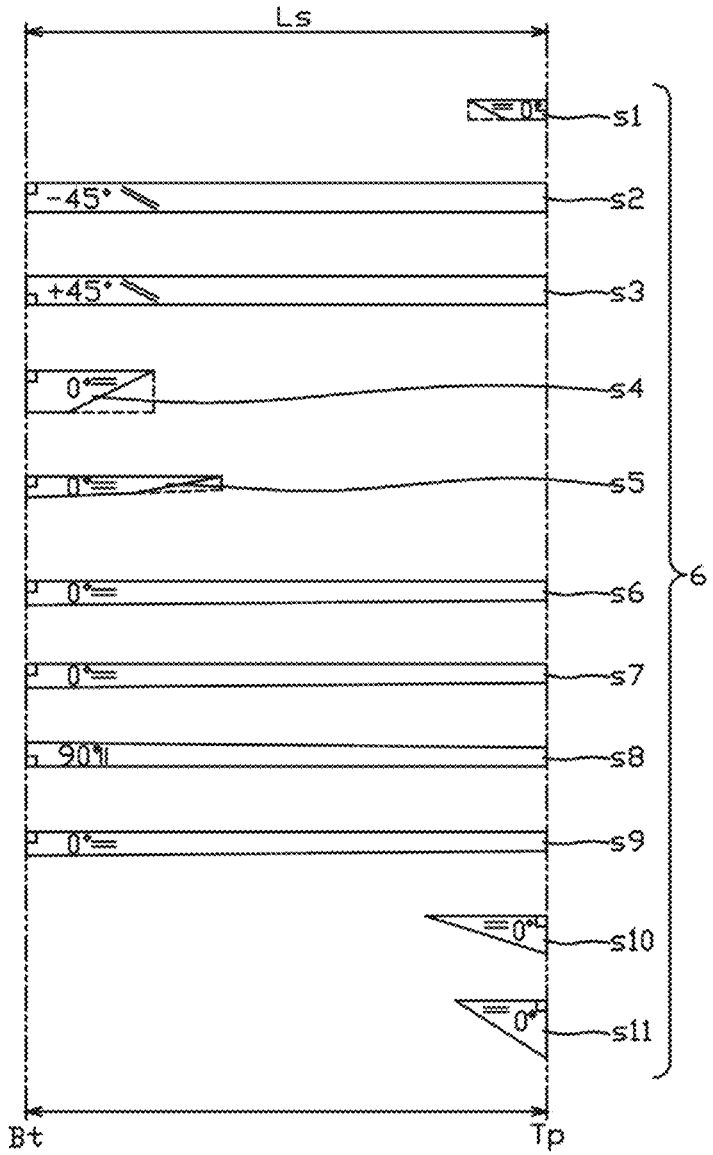
FIG. 2 is a development view showing an example of a sheet configuration of a shaft.

FIG. 2 is a development view of prepreg sheets configuring the shaft 6 (a configuration diagram of sheets). The shaft 6 is configured of a plurality of sheets. The shaft 6 is configured of eleven sheets from a first sheet s1 to an eleventh sheet s11. The development view illustrated in FIG. 2 illustrates the sheets configuring the shaft in order from the inner side in the radial direction of the shaft. The sheets are wound in order from the sheet located on the upper side in the development view. In FIG. 2, the lateral direction in the drawing corresponds to the axial direction of the shaft. In FIG. 2, the right side in the drawing is the tip end Tp side of the shaft. In FIG. 2, the left side in the drawing is the butt end Bt side of the shaft.

The development view illustrates the order of winding the sheets as well as the disposition of the sheets in the axial direction of the shaft (shaft axial direction). For example in FIG. 2, the tip ends of the sheets s1, s10, and s11 are located at the shaft tip end Tp. For example in FIG. 2, the back ends of the sheets s4 and s5 are located at the shaft butt end Bt.

In the present application, the term "layer" and the term "sheet" are used. A "layer" is wound, and a "sheet" is not wound. A "layer" is formed by winding a "sheet". That is, a wound "sheet" forms a "layer". Moreover, in the present application, the same reference numerals and signs are used for the layer and the sheet. For example, a layer formed of the sheet s1 is a layer s1.

The shaft 6 includes a straight layer, a bias layer, and a hoop layer. In the development view of the present application, an orientation angle Af of fiber is denoted in the sheets. The orientation angle Af is an angle with respect to the shaft axial direction.

The sheet having the notation "0 degree" configures the straight layer. The sheet for the straight layer is also referred to as a straight sheet in the present application.

The straight layer is a layer in which the fiber orientation is substantially at an angle of 0 degree with respect to the shaft axial direction. Because of errors, for example, in winding, the fiber orientation may not be exactly 0 degree with respect to the shaft axial direction. Generally, in the straight layer, an absolute angle θa is equal to or less than 10 degrees.

It is noted that the absolute angle θa means the absolute value of the orientation angle Af. For example, the phrase that the absolute angle θa is equal to or less than 10 degrees means that the angle Af is −10 degrees or greater and +10 degrees or less.

In the embodiment in FIG. 2, the straight sheets are the sheet s1, the sheet s4, the sheet s5, the sheet s6, the sheet s7, the sheet s9, the sheet s10, and the sheet s11. The straight layer has a high correlation with the flexural rigidity and flexural strength of the shaft.

The bias layer has a high correlation with the torsional rigidity and torsional strength of the shaft. Preferably, the bias sheet includes a pair of two sheets in which the fiber orientations are inclined in directions opposite to each other. From the viewpoint of torsional rigidity, the absolute angle θa of the bias layer is preferably equal to or greater than 15 degrees, more preferably equal to or greater than 25 degrees, and still more preferably equal to or greater than 40 degrees. From the viewpoint of torsional rigidity and flexural rigidity, the absolute angle θa of the bias layer is preferably equal to or less than 60 degrees, and more preferably equal to or less than 50 degrees.

In the shaft 6, the sheets configuring the bias layer are the second sheet s2 and the third sheet s3. As discussed above, in FIG. 2, the angle Af is denoted for the individual sheets. The notations positive (+) and minus (−) in the angle Af express that the fibers in the bias sheets are inclined in directions opposite to each other. In the present application, the sheet for the bias layer is also simply referred to as a bias sheet. The sheet s2 and the sheet s3 configure the pair of sheets.

In FIG. 2, the inclined direction of the fiber of the sheet s3 is the same as the inclined direction of the fiber of the sheet s2. However, as described later, the sheet s3 is reversed, and stacked to the sheet s2. As a result, the inclined direction of the sheet s2 and the inclined direction of the sheet s3 are in directions opposite to each other.

In the shaft 6, the sheet configuring the hoop layer is the eighth sheet s8. Preferably, the absolute angle θa in the hoop layer is set substantially at 90 degrees with respect to the shaft axis. However, because of errors, for example, in winding, the fiber orientation may not be exactly 90 degrees with respect to the shaft axial direction. Generally, in the hoop layer, the absolute angle θa is 80 degrees or greater and 90 degrees or less. In the present application, the prepreg sheet for the hoop layer is also referred to as a hoop sheet.

The number of layers formed using a single sheet is not limited. For example, if the number of sheet plies is 1, this sheet is wound once in the circumferential direction. If the number of sheet plies is 1, this sheet forms a single layer at all the positions in the circumferential direction of the shaft.

For example, if the number of sheet plies is 2, this sheet is wound twice in the circumferential direction. If the number of sheet plies is 2, this sheet forms two layers at all the positions in the circumferential direction of the shaft.

For example, if the number of sheet plies is 1.5, this sheet is wound 1.5 times in the circumferential direction. If the number of sheet plies is 1.5, this sheet forms a single layer at positions in the circumferential direction at angles of 0 to 180 degrees and forms two layers at positions in the circumferential direction at angles of 180 degrees to 360 degrees.

As described above, in the present application, the sheets and the layers are classified based on the orientation angle of fiber. Moreover, in the present application, the sheets and the layers are classified based on the length in the shaft axial direction.

In the present application, a layer disposed over the entire length in the shaft axial direction is referred to as a full length layer. In the present application, a sheet disposed over the entire length in the shaft axial direction is referred to as a full length sheet. A wound full length sheet forms a full length layer.

In the present application, a layer partially disposed in the shaft axial direction is referred to as a partial layer. In the present application, a sheet partially disposed in the shaft axial direction is referred to as a partial sheet. A wound partial sheet forms a partial layer.

In the present application, a full length layer that is a straight layer is referred to as a full length straight layer. In the embodiment in FIG. 2, the full length straight layers are a layer s6, a layer s7, and a layer s9. The full length straight sheets are the sheet s6, the sheet s7, and the sheet s9.

In the present application, a full length layer that is a hoop layer is referred to as a full length hoop layer. In the embodiment in FIG. 2, the full length hoop layer is a layer s8. The full length hoop sheet is the sheet s8.

In the present application, a partial layer that is a straight layer is referred to as a partial straight layer. In the embodiment in FIG. 2, the partial straight layers are the layer s1, a layer s4, a layer s5, a layer s10, and a layer s11. The partial straight sheets are the sheet s1, the sheet s4, the sheet s5, the sheet s10, and the sheet s11.

In the present application, a partial layer that is a hoop layer is referred to as a partial hoop layer. The embodiment in FIG. 2 includes no partial hoop layers.

In the present application, the term "butt partial layer" is used. The butt partial layer is a layer which reaches the butt end Bt, but does not reach the tip end Tp. Examples of the butt partial layer include a butt straight layer and a butt hoop layer. In the embodiment in FIG. 2, the butt straight layers are the layer s4 and the layer s5. In the embodiment in FIG. 2, the butt hoop layer is not provided. The butt partial layer can contribute to the adjustment of an inertia moment Isw (described later). The butt partial layer can contribute to the adjustment of an inertia moment Ige (described later). The butt partial layer can contribute to the adjustment of a club inertia moment Ic (described later).

In the present application, the term "tip partial layer" is used. The tip partial layer is a layer which reaches the tip end Tp, but does not reach the butt end Bt. Examples of the tip partial layer include a tip straight layer. In the embodiment in FIG. 2, the tip straight layers are the layer s1, the layer s10, and the layer s11. The tip partial layer improves the strength of the tip end part of the shaft 6. The tip partial layer can contribute to the adjustment of an inertia moment Isw (described later). The tip partial layer can contribute to the adjustment of an inertia moment Ige (described later). The tip partial layer can contribute to the adjustment of an inertia moment Ic (described later).

The shaft 6 is prepared by the sheet winding method using the sheets illustrated in FIG. 2.

The sheet winding method is excellent in the degree of freedom for design. By this method, weight distribution of the shaft 6 can be easily adjusted. By this method, the inertia moments Isw, Ige, Ic, and the like can be adjusted. Examples of methods for adjusting the inertia moments include (A1) to (A9) below.

(A1) Increasing or decreasing the number of windings of the butt partial layer.

(A2) Increasing or decreasing the thickness of the butt partial layer.

(A3) Increasing or decreasing the length of the butt partial layer in the axial direction.

(A4) Increasing or decreasing the number of windings of the tip partial layer.

(A5) Increasing or decreasing the thickness of the tip partial layer.

(A6) Increasing or decreasing the length of the tip partial layer in the axial direction.

(A7) Increasing or decreasing the taper ratio of the shaft.

(A8) Increasing or decreasing the resin content in all the layers.

(A9) Increasing or decreasing the prepreg areal weight in all the layers.

In the present application, the club weight is defined as Wc (kg), the head weight is defined as Wh (kg), the shaft weight is defined as Ws (kg), and the grip weight is defined as Wg (kg).

In this embodiment, the inertia moments (the moments of inertia) below are considered. The unit of these inertia moments is "kg·cm$^2$".

(a) Club Inertia Moment Isw (b) Club Inertia Moment Ige

The club inertia moment Isw is an inertia moment about a swing axis Zx.

The club inertia moment Ige is a moment of inertia about a grip end. In more detail, the club inertia moment Ige is a moment of inertia about an axis Zy passing through the grip end.

In order to calculate the inertia moments using the parallel axis theorem, the inertia moments (the moments of inertia) below are used.

(c) Club Inertia Moment Ic

The following describes details of the inertia moments (a) and (b).

[Club Inertia Moment Isw]

Isw is the inertia moment of the golf club 2. Isw is the inertia moment about the swing axis Zx.

Figure 3:
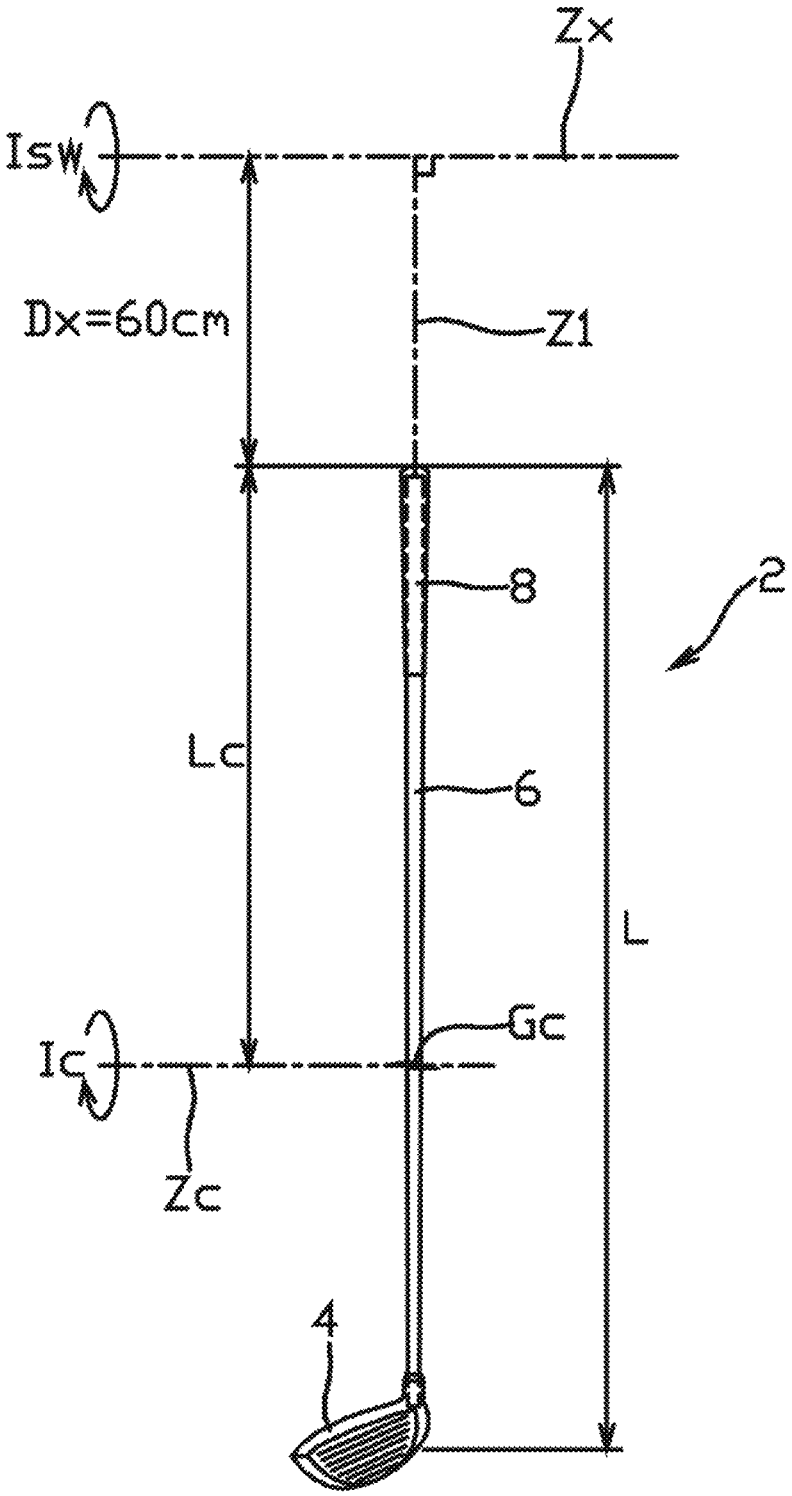
FIG. 3 is an illustration of a club inertia moment about a swing axis.

FIG. 3 is a conceptual diagram for describing the club inertia moment Isw.

As illustrated in FIG. 3, a distance Lc is an axial direction distance from the grip end to the center of gravity Gc of the club. The inertia moment Ic is the inertia moment of the club 2. The inertia moment Ic is the inertia moment about an axis Zc. As illustrated in FIG. 3, the axis Zc is parallel with the swing axis Zx. The axis Zc passes through the center of gravity Gc of the club.

The inertia moment Isw (kg·cm$^2$) is calculated by Equation (1) below. Equation (1) is based on the parallel axis theorem.

$$Isw = Wc \times (Lc + 60)^2 + Ic \quad (1)$$

As illustrated in FIG. 3, the swing axis Zx is set at a position at which a distance Dx from the grip end is 60 cm. The swing axis Zx is perpendicular to a shaft axis Z1. The axis Zx intersects the axis Z1 at a right angle.

[Club Inertia Moment Ige]

Ige is the moment of inertia of the golf club 2. Ige is the moment of inertia about the grip end.

Figure 4:
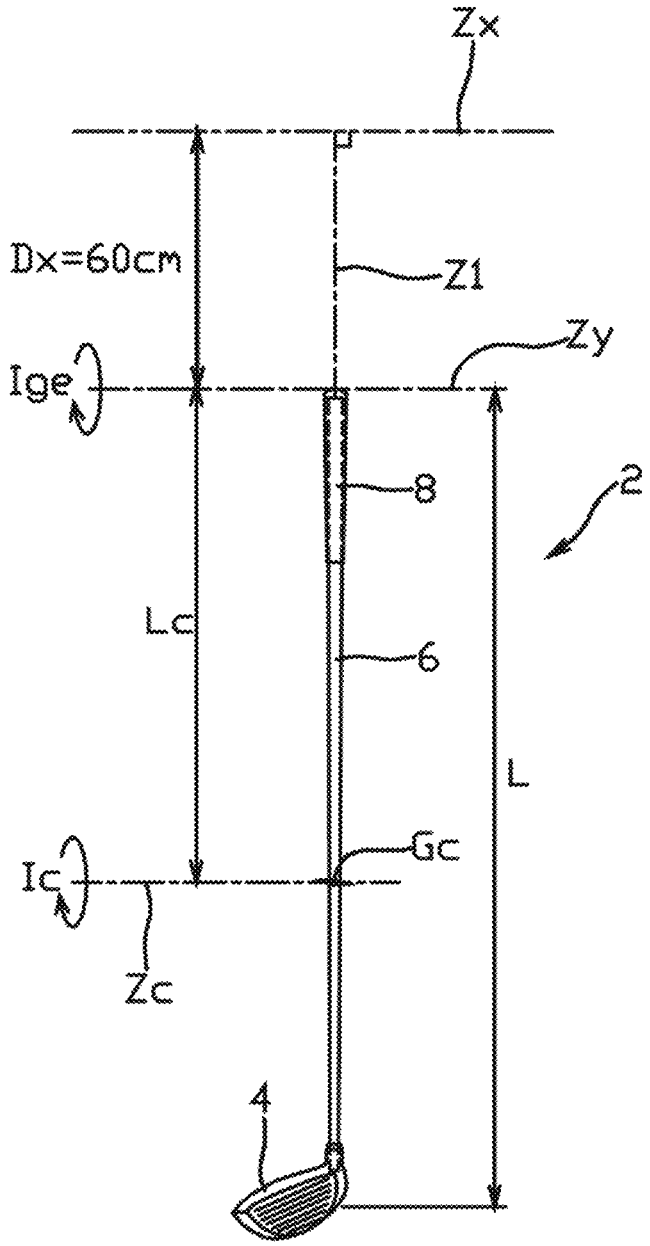
FIG. 4 is an illustration of a club inertia moment about a grip end.

FIG. 4 is a conceptual diagram for describing the club inertia moment Ige.

Ige is the moment of inertia about the axis Zy. The axis Zy passes through the grip end of the golf club 2. The axis Zy is parallel to the axis Zx and the axis Zc. The axis Zy is perpendicular to the shaft axis Z1. The axis Zy intersects the axis Z1 at a right angle.

The inertia moment Ige (kg·cm$^2$) is calculated by Equation (2) below. Equation (2) is based on the parallel axis theorem.

$$Ige = Wc \times (Lc)^2 + Ic \quad (2)$$

Conventionally, a swing balance (a club balance) is known as an index of the ease of a swing. However, the swing balance is a static moment, and not a dynamic index.

A swing is dynamic. A dynamic index can accurately reflect the ease of a swing. For the dynamic index of the ease of a swing, the inertia moment Isw about the swing axis can be used.

Furthermore, in the present embodiment, the inertia moment Ige is used in addition to the inertia moment Isw.

In actual swings, a wrist cock occurs. The wrist cock is maintained in the early stage of a downswing. The wrist cock is gradually released as an impact approaches.

In actual swings, the rotation center of the swing is the body of a golf player. When the amount of wrist cock is high, the golf club 2 passes close to the body. In other words, amount of wrist cock is high, the golf club 2 passes close to the rotation center. An effective club inertia moment about the swing axis can depend on the degree of the wrist cock. In order to maximize a head speed, it is preferable to consider the influence of the wrist cock.

A swing simulation was used in order to confirm the influence of the wrist cock. A two-link rigid body model was used for the simulation.

Figure 5:
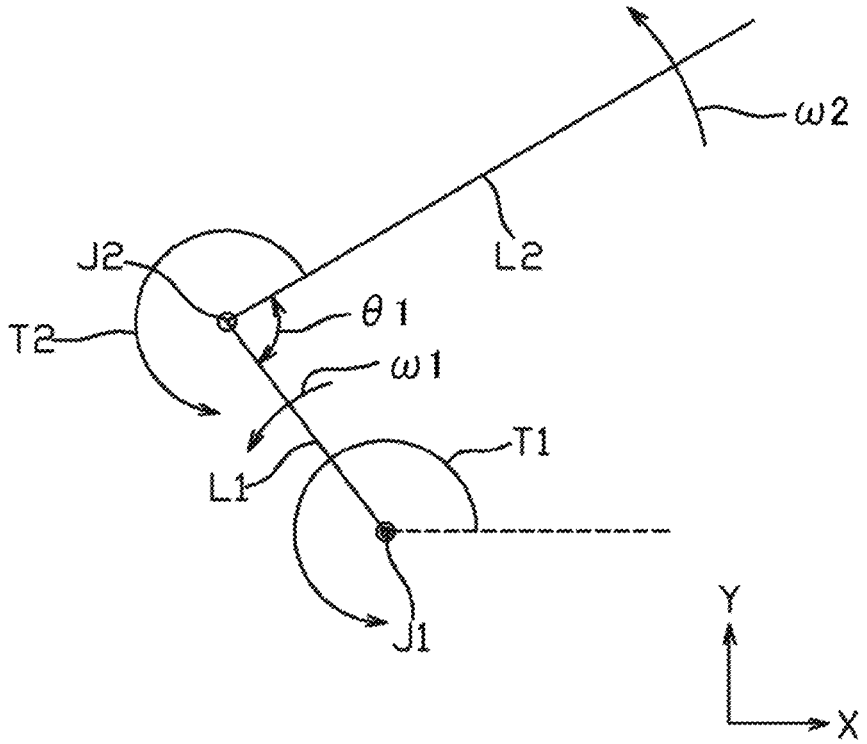
FIG. 5 is a conceptual diagram of a two-link model of rigid bodies.

FIG. 5 is a schematic diagram of a two-link model used in the simulation. The two-link model is a rigid body link model.

The two-link model includes a first link LE a second link L2, a joint J1, and a joint J2. The first link L1 is a rigid body. The second link L2 is a rigid body.

One end of the first link L1 is connected to the joint J1. The other end of the first link L1 is connected to the joint J2. One end of the second link L2 is connected to the joint J2. The other end of the second link L2 is a free end.

The first link L1 corresponds to an arm. The second link L2 corresponds to a golf club. The joint J1 corresponds to a shoulder joint. The joint J2 corresponds to a wrist joint. The speed of the free end of the second link L2 is a head speed.

An angle θ1 between the first link L1 and the second link L2 corresponds to the angle of the wrist cock. In a state where the wrist cock is accumulated, the angle θ1 is small. The release of the wrist cock is started before the impact. The angle θ1 is gradually increased by the release of the wrist cock. Usually, in the impact, the angle θ1 is close to 180 degrees.

The degree of the wrist cock depends on the golf player. For example, the degree of the wrist cock in a golf player having great strength is greatly different from the degree of the wrist cock in a golf player having small strength. The capability of the release (release capability) of the wrist cock also depends on the golf player. From these viewpoints, the golf player is classified into four types. The four types are types 1 to 4. The golf player of the type 1 has a very low head speed. The golf player of the type 2 has a low head speed. The golf player of the type 3 has a slightly high head speed. The golf player of the type 4 has a high head speed.

Generally, as the head weight Wh increases, an increase in a ball speed is anticipated. Meanwhile, as the head weight Wh increases, the center of gravity Gc moves to the head 4 side; the inertia moment Ige is increased; and it becomes difficult to swing the golf club. For this reason, generally, a golf club having a small inertia moment Ige is suitable for a golf player having small strength, and a golf club having a large inertia moment Ige is suitable for a golf player having great strength. That is, the skill of the golf player can be defined based on the size of a suitable inertia moment Ige. The golf player of the type 4 is a golf player for which a golf club having an inertia moment Ige of 2920 ($kg \cdot cm^2$) or greater and less than 2970 ($kg \cdot cm^2$) is suitable, and corresponds to the golf player having great strength.

The present application is directed to the golf player of the type 4. Multiple golf clubs to be verified (hereinafter referred to as "target clubs") were selected based on empirical values, and were analyzed.

Before the analysis, seven golf players belonging to the type 4 executed a trial hit with a test club. In the trial hit, a test club suitable for the golf player of the type 4 was used. A sensor was attached to the grip end of the test club. The sensor included a three-dimensional acceleration sensor and a three-dimensional angular velocity sensor. Information from the sensor (sensor information) was obtained by the trial hit.

In the analysis, inverse dynamics analysis was performed using the sensor information and the specifications of the test club (weight, position of the center of gravity, moment of inertia, club length). A shoulder torque T1 and a wrist torque T2 were calculated by the inverse dynamics analysis. The shoulder torque T1 is torque exhibited about the shoulder in the trial hit. The wrist torque T2 is torque exhibited about the wrist in the trial hit.

Next, forward dynamics analysis was performed using the specifications of the target clubs, the shoulder torque T1, and the wrist torque T2. In the forward dynamics analysis, the specifications of the target clubs were applied to the second link L2. In the forward dynamics analysis, the shoulder torque T1 was applied to the joint J1, and the wrist torque T2 was applied to the joint J2. As a result of the forward dynamics analysis, a swing model of the test golf player of the type 4 was obtained. A head speed in the impact when each target club was used was simulated and calculated with the swing model.

Figure 6:
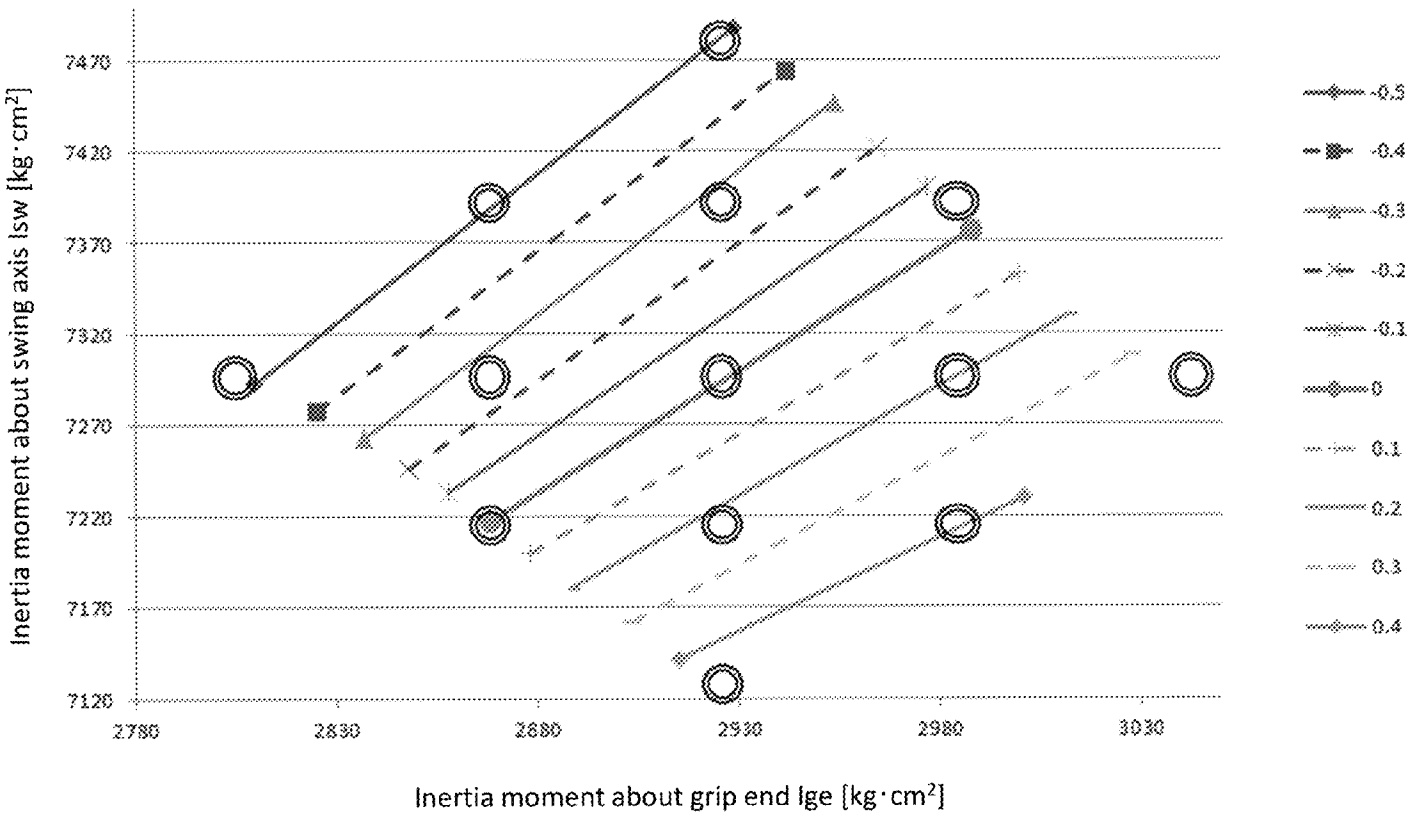
FIG. 6 is a graph showing a simulation result for a head speed.

Next, these head speeds were verified using the swing model. A head speed in each of the club specifications was calculated by the simulation. FIG. 6 is a graph showing an example of a simulation result. In FIG. 6, a horizontal axis is the inertia moment Ige, and a vertical axis is the inertia moment Isw.

In the simulation of FIG. 6, thirteen target clubs were provided. The thirteen specifications of the target clubs are shown by a double-lined circle in FIG. 6.

A head speed in each of the club specifications was calculated for each of swing data sets of the seven golf players. A contour drawing of the obtained head speeds is shown in FIG. 6. Ten contour lines are drawn in the contour drawing. A contour line as a reference value is shown by a solid line between circles. The contour lines are drawn at intervals of 0.1 m/s. The upper-left-most contour line has a head speed smaller by 0.5 m/s than the reference value. The lower-right-most contour line has a head speed greater by 0.4 m/s than the reference value. As shown in the contour drawing, the head speed increases toward the lower right. In other words, as the inertia moment Ige increases and the inertia moment Isw decreases, the head speed increases. This shows the effectiveness of setting Isw/Ige to be equal to or less than a predetermined value.

The result shown in FIG. 6 shows that the head speed can be improved even if the inertia moment Ige about the grip end is increased. Therefore, the result can show that the head speed can be improved even if the head weight is increased. By the suitable relationship between the inertia moment Ige and the inertia moment Isw, the head speed can be improved while the head weight can be maintained at a predetermined value or greater. Thereby, the increase in the flight distance can be achieved.

The result shown in FIG. 6 matches an effect provided by an effective swing MI (described later). As the inertia moment Ige increases, the wrist cock is more likely to accumulate. By the wrist cock, the effective swing MI can be decreased, and the head speed can be improved. The advantages provided by the decrease in the effective swing MI can exceed the disadvantages caused by the increase in the inertia moment Isw. In consideration of the wrist cock, the simulation result is rationally understood.

In FIG. 6, the contour line is aligned in an upper right direction. This shows the effectiveness of selecting the combination of (Ige, Isw) below a straight line having a predetermined positive inclination in an Ige (horizontal axis)-Isw (vertical axis) plane. In other words, the result of the simulation shows that it is effective in the improvement in the head speed to set Isw/Ige to be equal to or less than a predetermined value.

In actual swings, the golf club is not rotated about the grip end. The golf club is rotated about the body of a golf player together with the arms of the golf player. In the present application, the swing axis Zx is set in consideration of actual swings. The swing axis is away from the grip end. In order to evaluate the ease of a dynamic swing, a spacing Dx between the swing axis Zx and the grip end is set (see FIG. 3). In consideration of actual swings, in Equation (1) above, the value [Lc+60] is used.

A swing is dynamic. As compared with the static index, the dynamic index tends to reflect the ease of a swing. Moreover, as described above, the actual conditions of swings are considered for the inertia moment Isw. Therefore, the inertia moment Isw accurately reflects the ease of a swing.

Meanwhile, in actual swings, wrist cock occurs. Wrist cock is rotation of the club about the grip end. Therefore, wrist cock has a high correlation with the club inertia moment Ige.

As described above, in actual swings, the club passes closer to the body as the wrist cock is accumulated. That is, the club passes closer to the body as the angle θ1 decreases. Therefore, in actual swings, the effective club inertia moment tends to be smaller as the wrist cock is accumulated. The moment of inertia about the swing axis considering the wrist cock is also referred to as the effective swing MI.

As described above, in a state where the wrist cock is maintained, the effective swing MI is small. Therefore, in this case, the head speed is likely to be increased. However, in order to achieve a square impact, it is necessary to release the wrist cock. This is because the face is opened in the impact while the wrist cock is maintained. Release timing affects the head speed.

Figure 7:
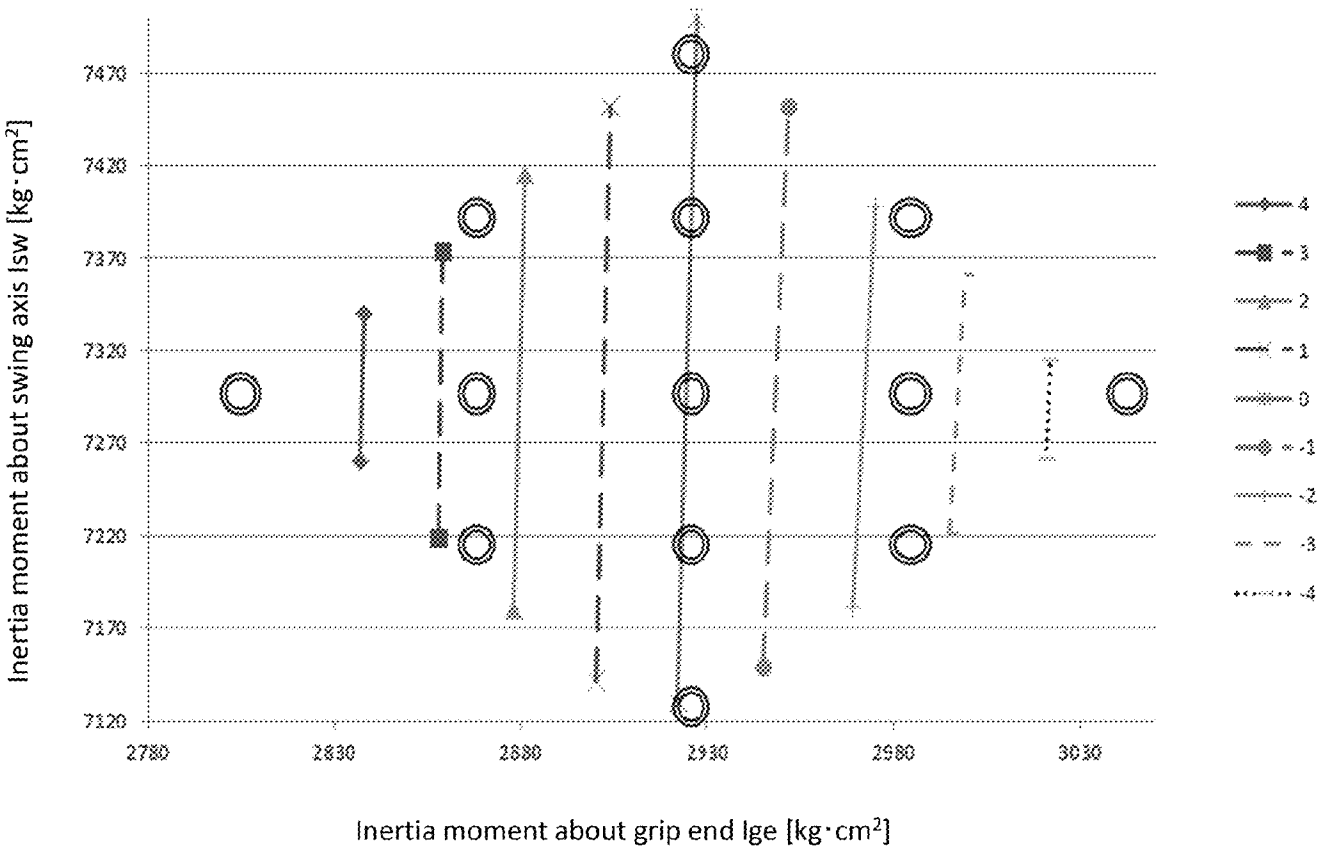
FIG. 7 is a graph showing a simulation result for a cock angle.

FIG. 7 is a contour drawing of the minimum value of the angle θ1 in an Ige-Isw plane. The minimum value of θ1 expresses the maximum amount of the wrist cock accumulated during a swing motion. More specifically, FIG. 7 is a contour drawing drawn based on thirteen inflexion points of angles θ1 simulated and calculated for the above-mentioned thirteen target clubs. FIG. 7 shows that the wrist cock is more likely to be accumulated toward the right. On the contrary, FIG. 7 shows that the wrist cock is less likely to be accumulated toward the left. Meanwhile, since the contour line of FIG. 7 extends substantially vertically, the wrist cock is hardly affected by the inertia moment Isw. Therefore, it is found that, regardless of the inertia moment Isw, the wrist cock is more likely to be accumulated as the inertia moment Ige is larger, and the wrist cock is less likely to be accumulated as the inertia moment Ige is smaller.

Figure 8:
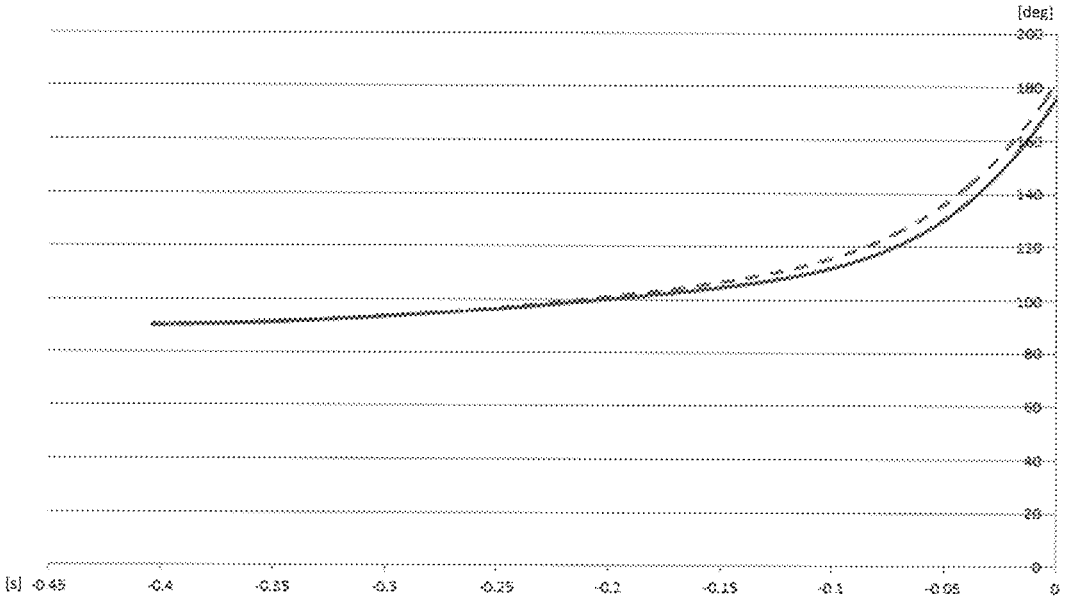
FIG. 8 shows a cock angle during a downswing.

The release of the wrist cock increases the relative speed of the head to the wrist. A suitable release can contribute to an improvement in the head speed. Ideally, it is preferable that the wrist cock is sufficiently accumulated, and the wrist cock is released at once just before the impact. For example, when two swings shown in FIG. 8 are compared, from the viewpoint of the improvement in the head speed, the swing as shown by the solid line is more ideal than the swing as shown by the dashed line. The horizontal axis of FIG. 8 shows a time axis (0: impact), and the vertical axis shows an angle θ1. The unit of the horizontal axis of FIG. 8 is seconds (sec), and the unit of the vertical axis is degrees (deg). FIG. 8 shows the results of the trial hits by the same golf player using two different golf clubs. The inertia moment Ige corresponding to the golf club shown by the solid line is larger than the inertia moment Ige corresponding to the golf club shown by the dashed line. Accordingly, the larger Ige is, the later the release timing of the wrist cock is. However, the degree of the wrist cock and the degree of release (wrist torque) vary depending on the type of the golf player. The compatibility of the type of the golf player with the golf club increases the head speed.

Thus, the degree of the wrist cock and the release timing of the wrist cock affect the head speed. As described above, the degree of the wrist cock and the degree of the release depend on the golf player. Conditions for optimizing the head speed are set for every type of the golf player. In the golf player of the type 4 for which the club satisfying the condition (B) below is suitable, the head speed can be improved when the condition (A) below is also satisfied. In the golf player of the type 4, the wrist cock can be accumulated and the suitable release can also be achieved when (A) and (B) are satisfied. Therefore, the head speed is increased.

$$Isw/Ige \leq 2.48 \quad \text{(A)}$$

$$2920 \leq Ige < 2970 \quad \text{(B)}$$

Figure 9:
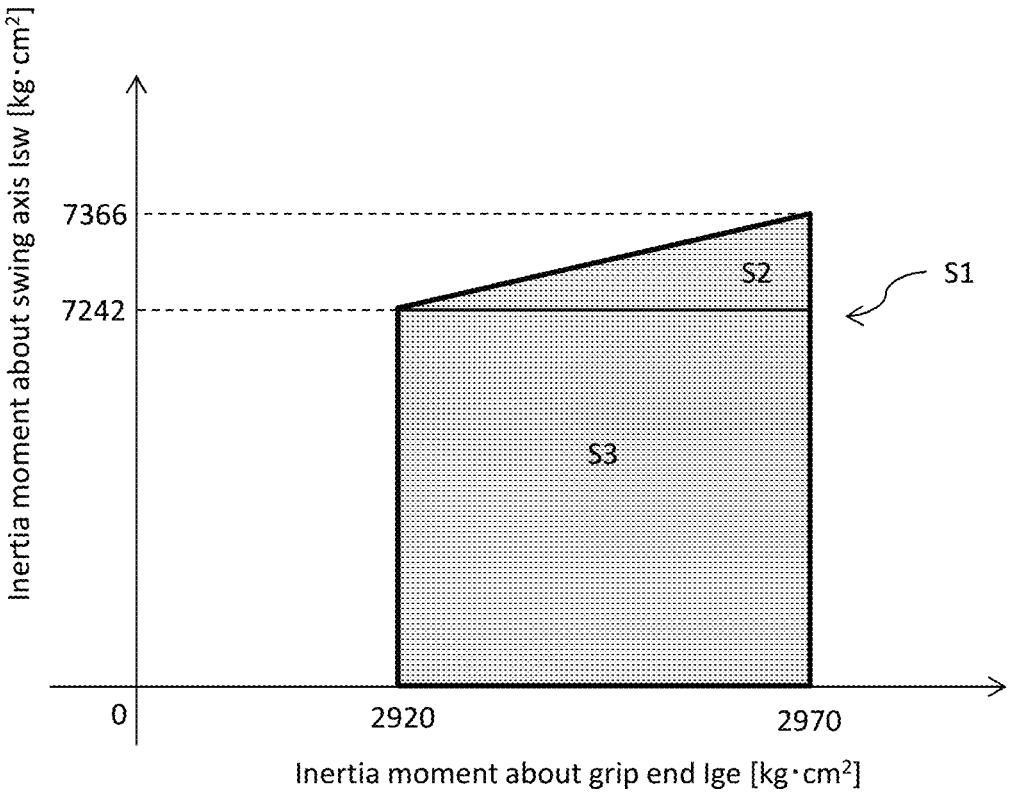
FIG. 9 is an Ige-Isw plane showing a range suitable for a golf player to which the present application is directed.

A region S1 satisfying the above conditions (A) and (B) in the Ige-Isw plane can be expressed as shown in FIG. 9. In more detail, S1 can be divided into a region S2 and a region S3. Although Isw is comparatively large in the region S2, the effective swing MI is reduced by the effect of the wrist cock. Therefore, in the region S2, the head speed can be improved. In the region S3, Isw is comparatively small, and the effective swing MI is reduced by the effect of the wrist cock. Therefore, in the region S3, the head speed can be further improved as compared with the region S2. As a result, since a swing with more accumulated wrist cock can be achieved even when both Ige and Isw are increased, the head speed can be increased.

The region S2 is a region satisfying a condition of (C) below in addition to (A) and (B) above. The region S3 is a region satisfying a condition of (D) below in addition to (B) above.

$$Isw \geq 7241.6 \quad \text{(C)}$$

$$Isw < 7241.6 \quad \text{(D)}$$

Even if Isw is the same or larger in the region S2, the cock causes a decrease in the effective swing MI. In the region S3, Isw is decreased, and the cock causes a decrease in the effective swing MI.

Since an effect provided by the decrease in the effective swing MI is large in the region S2, the head speed can be improved even if Isw is large. In the region S3, the head speed can be further improved.

Thus, even if both Ige and Isw are increased by an increase in the head weight, a swing accumulating the cock can be achieved. Therefore, the effective swing MI can be decreased, and the head speed can be improved.

When the head weight is increased, a rebound performance can be improved. However, the head speed may be reduced. In the present embodiment, by the increase in the head weight, the inertia moment Ige is increased, and the wrist cock is likely to be maintained. The effective swing MI can be reduced by maintaining the wrist cock. Therefore, even if the head weight is increased, the head speed can be improved. By appropriately setting the ratio between Isw and Ige, the head speed can be improved while the head weight can be increased. The amount of wrist cock increases due to the increase in Ige and Isw becomes reduced, resulting in that the head speed is improved.

The axis Zc shown in FIG. 3 passes through the center of gravity Gc of the club. The axis Zc is parallel to the swing axis Zx. The inertia moment Ic is the moment of inertia of the club 2 about the axis Zc. The swing axis Zx intersects the shaft axis Z1 at a right angle. The axis Zc intersects the shaft axis Z1 at a right angle.

The axis Zy shown in FIG. 4 passes through the grip end. The axis Zy is parallel to the swing axis Zx and the axis Zc. The axis Zy intersects the shaft axis Z1 at a right angle.

In the present application, a reference state (not illustrated) is defined. The reference state is a state in which the club 2 is placed on a horizontal plane at a specified lie angle and a real loft angle. In the reference state, the shaft axis Z1 is included in a plane VP1 perpendicular to the horizontal plane. The plane VP1 is defined as a reference vertical plane. The specified lie angle and real loft angle are described in product catalogs, for example. As apparent from FIGS. 3 and 4, in the calculation of the inertia moments, the face surface is in a substantially square state with respect to the head path. The orientation of the face surface is in the state of an ideal impact. The swing axis Zx is included in the reference vertical plane. That is, in the measurement of the inertia moment Isw, the swing axis Zx is included in the reference vertical plane. In the measurement of the inertia moment Ic, the axis Zc is included in the reference vertical plane. The foregoing inertia moments reflect the attitude of the club near an impact. The foregoing inertia moments reflect swings. Therefore, these inertia moments have a high correlation with the ease of a swing.

The axis Zy is included in the reference vertical plane. That is, in the measurement of the inertia moment Ige, the swing axis Zy is included in the reference vertical plane.

It is assumed that the center of gravity Gc of the club is located on the shaft axis Z1. Because of the position of the center of gravity of the head, the real center of gravity of the club is slightly deviated from the shaft axis Z1. The real center of gravity of the club can be located in a space, for example. In the present application, it is assumed that a point on the axis Z1 closest to the real center of gravity of the club is the center of gravity Gc of the club described above. In other words, the center of gravity Gc of the club in the present application is an intersection point between the axis Z1 and a perpendicular line from the real center of gravity of the club to the axis Z1. The approximation of the position of the center of gravity of the club gives a slight difference to the value of Isw and Ige. However, the difference is so small that the difference does not affect the effects described in the present application.

From the viewpoint of the ease of a swing, the inertia moment Isw is preferably equal to or less than 7360 ($kg \cdot cm^2$), more preferably equal to or less than 7300 ($kg \cdot cm^2$), still more preferably equal to or less than 7280 ($kg \cdot cm^2$), yet still more preferably equal to or less than 7260 ($kg \cdot cm^2$), yet still more preferably equal to or less than 7240 ($kg \cdot cm^2$), yet still more preferably equal to or less than 7220 ($kg \cdot cm^2$). From the viewpoint of suppressing an excessively small head weight Wh, the inertia moment Isw is preferably equal to or greater than 6300 ($kg \cdot cm^2$), and more preferably equal to or greater than 6350 ($kg \cdot cm^2$).

As described above, in the golf player of the type 4, the inertia moment Ige is preferably equal to or greater than 2920 ($kg \cdot cm^2$). From the viewpoint of promoting the wrist cock to reduce the effective swing MI, the inertia moment Ige is equal to or greater than 2930 ($kg \cdot cm^2$) for the golf player of the type 4. As described above, the inertia moment Ige for the golf player of the type 4 is preferably less than 2970 ($kg \cdot cm^2$). From the viewpoint of suitable release of the wrist cock, the inertia moment Ige is preferably equal to or less than 2960 ($kg \cdot cm^2$), and more preferably equal to or less than 2950 ($kg \cdot cm^2$).

As described above, by considering a ratio (Isw/Ige), the ease of a swing is achieved, and an appropriate wrist cock is achieved. The appropriate wrist cock can decrease the effective swing MI and increase the head speed. The increase in the head weight increases Ige. The appropriate increase in Ige promotes the wrist cock, and increases the head speed. By considering the wrist cock and the effective swing MI, the increase in the head speed can be achieved even if the head weight is increased. From this viewpoint, Isw/Ige is preferably equal to or less than 2.48. Excessive Ige may cause insufficient release of the wrist cock. From this viewpoint, Isw/Ige is preferably equal to or greater than 2.40. The contour line (Isw/Ige) shown in FIG. 6 is generally upward sloping. The present inventors performed intensive studies in a hitting test, and found that Isw/Ige is preferably equal to or less than 2.48 as described above.

In the present embodiment, the inertia moment Isw is considered. The inertia moment Isw is a dynamic index. The substance of a swing is reflected in the inertia moment Isw.

Furthermore, in the present embodiment, Isw/Ige is set to be equal to or less than a predetermined value. The inertia moment Ige increases the wrist cock. The inertia moment Isw is a dynamic index which can optimize the ease of a swing. To a greater or lesser extent, the actual swings involve the wrist cock. The characteristic of the swing is more correctly reflected by considering both the inertia moment Isw and the inertia moment Ige. The wrist cock is promoted by increasing the inertia moment Ige, and the inertia moment Isw is suppressed, and thereby the ease of a swing can be increased while the effective swing MI can be decreased.

A swing weight (club balance) is generally used as the index of the ease of a swing. When the head weight Wh is increased, the swing weight tends to be increased. For this reason, a reduction in the swing weight has been considered as in a reduction in the head weight Wh. There has been known a technical thought that the ease of a swing and the reduction in the head weight Wh are linked. The technical thought has been common for the person skilled in the art.

Meanwhile, in the present embodiment, even if the head weight Wh is increased, the head speed can be increased. This is achieved by the optimization of the wrist cock. When the head weight is increased, the swing weight is increased, but the wrist cock is promoted. The effective swing MI is decreased by maintaining the wrist cock, and the head speed can be increased. In the present embodiment, Isw/Ige is optimized. The degree of the wrist cock is correlated with the inertia moment Ige. The suitable wrist cock is obtained by making Isw/Ige proper, and the head speed can be improved.

[Head Weight Wh]

Even if the head weight Wh is increased, the head speed can be improved by considering Isw/Ige as described above. The optimization of Isw/Ige is achieved by not only the increase in the head weight Wh but also the reduction in the shaft weight Ws or grip weight Wg described later, for example.

The initial velocity of a ball is increased by the increase in the head weight Wh. From these viewpoints, the head weight Wh is preferably equal to or greater than 202 g (0.202 kg), more preferably equal to or greater than 203 g (0.203 kg), and still more preferably equal to or greater than 204 g (0.204 kg). From the viewpoint of the release capability of the golf player of the type 4, the head weight Wh is preferably equal to or less than 210 g (0.210 kg), more preferably equal to or less than 205 g (0.205 kg).

[Shaft Weight Ws]

From the viewpoint of the strength and durability of the shaft, the shaft weight Ws is preferably equal to or greater than 50 g (0.050 kg), more preferably equal to or greater than 52 g (0.052 kg), and still more preferably equal to or greater than 54 g (0.054 kg). From the viewpoint of the ease of a swing, the shaft weight Ws is preferably equal to or less than 70 g (0.070 kg), more preferably equal to or less than 68 g (0.068 kg), and still more preferably equal to or less than 66 g (0.066 kg).

[Grip Weight Wg]

From the viewpoint of achieving appropriate Isw, the grip weight is preferably equal to or less than 37 g (0.037 kg), more preferably equal to or less than 36 g (0.036 kg), still more preferably equal to or less than 35 g (0.035 kg), yet still more preferably equal to or less than 34 g (0.034 kg), yet still more preferably equal to or less than 33 g (0.033 kg), yet still more preferably equal to or less than 32 g (0.032 kg), yet still more preferably equal to or less than 31 g (0.031 kg), yet still more preferably equal to or less than 30 g (0.030 kg), yet still more preferably equal to or less than 29 g (0.029 kg), yet still more preferably equal to or less than 28 g (0.028 kg), yet still more preferably equal to or less than 27 g (0.027 kg), yet still more preferably equal to or less than 26 g (0.026 kg), and yet still more preferably equal to or less than 25 g (0.025 kg).

From the viewpoint of the strength and durability of the grip, the grip weight Wg is preferably equal to or greater than 15 g (0.015 kg), more preferably equal to or greater than 18 g (0.018 kg), and still more preferably equal to or greater than 20 g (0.020 kg).

The grip weight Wg can be adjusted by the volume of the grip, the specific gravity of rubber, the use of foamed rubber, and so on. The grip weight Wg may be adjusted by combining foamed rubber with non-foamed rubber.

[Shaft Length Lf2]

From the viewpoint of improving the head speed by increasing the rotation radius of a swing, the shaft length Lf2 is preferably equal to or greater than 99 cm, more preferably equal to or greater than 105 cm, still more preferably equal to or greater than 107 cm, and yet more preferably equal to or greater than 110 cm. From the viewpoint of suppressing variation in points to hit, the shaft length Lf2 is preferably equal to or less than 120 cm, more preferably equal to or less than 118 cm, and still more preferably equal to or less than 116 cm.

[Distance Lf1]

The center of gravity Gs of the shaft comes close to the butt end Bt, and a more weight can be distributed to the head. From this viewpoint, the distance Lf1 (see FIG. 1) is preferably equal to or greater than 560 mm, more preferably equal to or greater than 570 mm, still more preferably equal to or greater than 580 mm, and yet more preferably equal to or greater than 590 mm. In the case where the distance Lf1 is excessively large, since the weight that can be allocated to the tip end part of the shaft is decreased, the strength of the tip end part of the shaft is apt to decrease. From this viewpoint, the distance Lf1 is preferably equal to or less than 800 mm, more preferably equal to or less than 780 mm, and still more preferably equal to or less than 760 mm.

[Lf1/Lf2]

From the viewpoint of increasing weight distribution to the head to promote the wrist cock, Lf1/Lf2 is preferably equal to or greater than 0.53, more preferably equal to or greater than 0.55, still more preferably equal to or greater than 0.56, and yet still more preferably equal to or greater than 0.57. From the viewpoint of improving the strength of the tip end part of the shaft, Lf1/Lf2 is preferably equal to or less than 0.67, more preferably equal to or less than 0.66, and still more preferably equal to or less than 0.65.

[Club Length L]

From the viewpoint of improving the head speed, the club length L is preferably equal to or greater than 43 inches, more preferably equal to or greater than 44 inches, still more preferably equal to or greater than 45 inches, yet still more preferably equal to or greater than 45.2 inches, yet still more preferably equal to or greater than 45.3 inches, and yet still more preferably equal to or greater than 45.4 inches. From the viewpoint of suppressing variation in points to hit, the club length L is preferably equal to or less than 48 inches, more preferably equal to or less than 47 inches, still more preferably equal to or less than 46.5 inches, and yet still more preferably equal to or less than 46 inches.

The club length L in the present application is measured based on the golf rule of "1c. Length" in "1. Clubs" of "Appendix II. Design of Clubs", defined by R&A (Royal and Ancient Golf Club of Saint Andrews).

Particular importance is placed on the flight distance performance in the case of a driver. From this viewpoint, preferably, the club 2 is a driver. From the viewpoint of the flight distance performance, the real loft is preferably equal to or greater than 7 degrees, and preferably equal to or less than 14 degrees. From the viewpoint of enlarging a high restitution area, the volume of the head is preferably equal to or greater than 350 cc, more preferably equal to or greater than 380 cc, still more preferably equal to or greater than 400 cc, and yet still more preferably equal to or greater than 420 cc. From the viewpoint of the strength of the head, the volume of the head is preferably equal to or less than 470 cc.

[Club Weight Wc]

From the viewpoint of the ease of a swing, the club weight Wc is preferably equal to or less than 330 g (0.330 kg), more preferably equal to or less than 325 g (0.325 kg), still more preferably equal to or less than 320 g (0.320 kg), yet more preferably equal to or less than 315 g (0.315 kg), still yet more preferably equal to or less than 310 g (0.310 kg), and still more preferably equal to or less than 305 g (0.305 kg). In consideration of the strength of the grip, the shaft, and the head, the club weight Wc is preferably equal to or greater than 270 g (0.270 kg), more preferably equal to or greater than 275 g (0.275 kg), still more preferably equal to or greater than 280 g (0.280 kg), and yet more preferably equal to or greater than 285 g (0.285 kg).

[Wh/Wc]

From the viewpoint of the promotion of the wrist cock, a ratio (Wh/Wc) is preferably greater. A rebound performance is improved by the increase in the head weight Wh. From the viewpoint of the promotion of the wrist cock and the rebound performance, Wh/Wc is preferably equal to or greater than 0.66, and more preferably equal to or greater than 0.725. In consideration of the strength of the shaft and the like, the head weight is preferably equal to or less than a predetermined value. From this viewpoint, Wh/Wc is equal to or less than 0.80.

[Features]

In order to increase the flight distance, the increase in the ball speed is important. To achieve this, it is effective to improve the head speed and also increase the head weight. It is considered to make the golf club easy to swing, that is, to decrease the inertia moments Isw and Ige in order to achieve the former. However, to achieve decreasing the inertia moments Isw and Ige, the head weight is preferably smaller. This is because the heavier the head weight, the closer to the head side the center of gravity of the golf club, and the larger the inertia moments Isw and Ige. Therefore, the two approaches for increasing the flight distance are generally in a trade-off relation. Conventionally, it was difficult to achieve both the approaches.

As is apparent from Equations (1) and (2) above, when the inertia moment Ige is increased, the inertia moment Isw is also inevitably increased along with the increase in the inertia moment Ige. However, even if the inertia moment Ige is increased, the present inventors have found that the head speed can be rather improved if the increment of the inertia moment Isw to the increment of the inertia moment Ige is equal to or less than a predetermined value, as a result of the simulation shown in FIG. 6. This can be shown by the result of the simulation shown in FIG. 7. That is, this is because the wrist cock is likely to be accumulated when the inertia moment Ige is increased, which provides an improvement in the head speed.

Quantitatively speaking, Isw/Ige≤2.48 may be set for the golf player of the type 4 having great strength suitable for 2920 (kg·cm$^2$)≤Ige<2970 (kg·cm$^2$). When the combination of the inertia moments Isw and Ige satisfying the above conditions is selected, the head speed can be improved even if the larger inertia moments Ige is selected. In other words, the head speed can be improved while the head weight can be maintained. Therefore, from the viewpoints of both the head weight and the head speed, it is possible to apply a large kinetic energy to the ball. Therefore, the flight distance can be increased.

EXAMPLES

In the following, the effects of the present invention will be clarified by examples. However, the present invention should not be interpreted in a limited way based on the description of the examples.

Table 1 shows examples of prepregs usable for the shaft according to the present invention.

TABLE 1

Examples of Usable Prepregs

| Manufacturer | Prepreg Sheet Product Number | Sheet Thickness (mm) | Fiber Content (% by mass) | Resin Content (% by mass) | Carbon Fiber Physical Property Value: Carbon Fiber Product Number | Tensile Elastic Modulus (t/mm$^2$) | Tensile Strength (kgf/mm$^2$) |
|---|---|---|---|---|---|---|---|
| Toray Industries, Inc. | 3255S-10 | 0.082 | 76 | 24 | T700S | 23.5 | 500 |
| Toray Industries, Inc. | 3255S-12 | 0.103 | 76 | 24 | T700S | 23.5 | 500 |
| Toray Industries, Inc. | 3255S-15 | 0.123 | 76 | 24 | T700S | 23.5 | 500 |
| Toray Industries, Inc. | 805S-3 | 0.034 | 60 | 40 | M30S | 30 | 560 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Nippon Graphite Fiber Corporation | E1026A-09N | 0.100 | 63 | 37 | XN-10 | 10 | 190 |
| Mitsubishi Rayon co., Ltd | TR350C-100S | 0.083 | 75 | 25 | TR50S | 24 | 500 |
| Mitsubishi Rayon co., Ltd | TR350C-125S | 0.104 | 75 | 25 | TR50S | 24 | 500 |
| Mitsubishi Rayon co., Ltd | TR350C-150S | 0.124 | 75 | 25 | TR50S | 24 | 500 |
| Mitsubishi Rayon co., Ltd | MR350C-075S | 0.063 | 75 | 25 | MR40 | 30 | 450 |
| Mitsubishi Rayon co., Ltd | MR350C-100S | 0.085 | 75 | 25 | MR40 | 30 | 450 |
| Mitsubishi Rayon co., Ltd | MR350C-125S | 0.105 | 75 | 25 | MR40 | 30 | 450 |
| Mitsubishi Rayon co., Ltd | MR350E-100S | 0.093 | 70 | 30 | MR40 | 30 | 450 |
| Mitsubishi Rayon co., Ltd | HRX350C-075S | 0.057 | 75 | 25 | HR40 | 40 | 450 |
| Mitsubishi Rayon co., Ltd | HRX350C-110S | 0.082 | 75 | 25 | HR40 | 40 | 450 |

The tensile strength and the tensile elastic modulus are measured in accordance with "Testing Method for Carbon Fibers" JIS R7601: 1986

Example 1

A shaft in a stack configuration the same as the configuration of the shaft 6 was prepared. That is, a shaft in the configuration of the sheets illustrated in FIG. 2 was prepared. A manufacturing method was the same as the method for the shaft 6. Suitable prepregs were selected from the prepregs shown in Table 1. Prepregs were selected so as to have desired values for inertia moments, and the like. The shaft according to example 1 was obtained by the manufacturing method described above.

The obtained shaft was attached with a commercially available driver head (SRIXON Z725.: a loft angle of 9.5 degrees) and a grip, and a golf club according to example 1 was obtained. Table 2 shows the specifications and evaluation result of example 1.

Examples 2 and 3 and Comparative Examples 1 and 2

Shafts and golf clubs according to examples and comparative examples were obtained in the same way as example 1 except the specifications shown in Table 2 below.

In these examples and comparative examples, the head weight Wh was adjusted by polishing the outer surface of the head and using an adhesive. The adhesive was applied to the inner surface of the head. The adhesive is a thermoplastic adhesive, fixed to a predetermined position on the inner surface of the head at room temperature, and flows at high temperature. While the temperature of the adhesive was set at high temperature, the adhesive was poured into the head, and then cooled at ambient temperature for fixing. The adhesive was disposed so as not to change the position of the center of gravity of the head.

In the examples and comparative examples, the grip weight Wg was adjusted by the material and volume of the grip. Foamed rubber was used for the grip. The specific gravity of the grip was adjusted by a foaming rate.

In order to obtain a desired inertia moment Isw and inertia moment Ige, the specifications of the shaft were adjusted by the above-mentioned items (A1) to (A9) if needed.

TABLE 2

| | Unit | Comparative Example 1 | Example 1 | Comparative Example 2 | Example 2 | Example 3 |
|---|---|---|---|---|---|---|
| Club length L | Inch | 45 | 45 | 45 | 45 | 45 |
| Head weight Wh | gram | 202 | 205 | 204.5 | 203.5 | 202 |
| Shaft weight Ws | gram | 61 | 58 | 61 | 58 | 61 |
| Grip weight Wg | gram | 46.5 | 37 | 46.5 | 37 | 32 |
| Club weight Wc | gram | 313.5 | 304 | 316 | 302.5 | 299 |
| Wh/Wc | — | 0.644 | 0.674 | 0.647 | 0.673 | 0.676 |
| Inertia moment Isw | kg · cm$^2$ | 7285 | 7294 | 7361 | 7248 | 7216 |
| Inertia moment Ige | kg · cm$^2$ | 2921 | 2951 | 2954 | 2932 | 2920 |
| Isw/Ige | — | 2.494 | 2.471 | 2.492 | 2.472 | 2.472 |
| Angle θ1 when cock is released (difference with comparative example 1) | deg | 0 | −1.5 | −1 | −0.5 | 0 |
| Head speed | m/s | 48 | 48.06 | 47.76 | 48.12 | 48.18 |
| Ball initial velocity | m/s | 69.6 | 70.2 | 69.6 | 70.0 | 69.9 |

[Evaluation Method]

[Moments of Inertia]

The inertia moment Isw was calculated by Equation (1) described above. The inertia moment Ige was calculated by Equation (2) described above. The club inertia moment Ic was measured using MODEL NUMBER RK/005-002 made by INERTIA DYNAMICS Inc. The calculated values are shown in Table 2.

[Head Speed, Ball Initial Velocity]

Five test players belonging to the type 4 conducted the evaluation. Each test player hit a ball with each club for ten times. Therefore, hits were made for 50 times for each of the clubs in total. In the hits, the head speed in impact and the ball initial velocity were measured. The mean values of 50 items of data are shown in Table 2 above.

An angle θ1 when cock is released is a cock angle θ1 when the release of the cock is started. The values shown in Table 2 are differences with comparative example 1. It is shown that as the value decreases, the cock increases. For example, the values in examples 1 and 2 are smaller than the value in comparative example 1. It is found that the cock is greater in examples 1 and 2 as compared with comparative example 1.

The head speeds and ball speeds in examples 1 to 3 were greater than the head speeds and ball speeds in comparative examples 1 and 2. As shown in the evaluated results, the superiority of the present invention is apparent.

The method described above is applicable to golf clubs.

The description above is merely an example, and can be modified in various ways within the scope not deviating from the principles of the present invention.

What is claimed is:

1. A golf club comprising:

a head, a shaft, and a grip, wherein:

the head has a head weight Wh that is equal to or greater than 0.202 kg;

the golf club has a club length that is less than 46 inches;

if a club inertia moment about a swing axis is defined as Isw (kg·cm$^2$), and a club inertia moment about a grip end is defined as Ige (kg·cm$^2$), the inertia moment Ige is 2920 (kg·cm$^2$) or greater and less than 2970 (kg·cm$^2$), and Isw/Ige is equal to or less than 2.48;

if a club weight is defined as Wc (kg), an axial direction distance from the grip end to a center of gravity of the club is defined as Lc (cm), and a club inertia moment about the center of gravity of the club is defined as Ic (kg·cm$^2$), the inertia moment Isw (kg·cm$^2$) is calculated by Equation (1) below, and the inertia moment Ige (kg·cm$^2$) is calculated by Equation (2) below, $$Isw = Wc \times (Lc + 60)^2 + Ic \quad (1)$$

$$Ige = Wc \times (Lc)^2 + Ic \quad (2);$$

and wherein a grip weight Wg is equal to or less than 0.037 kg, and wherein the grip and the shaft do not include a weight member.

2. The golf club according to claim 1, wherein Wh/Wc is equal to or greater than 0.66.

3. The golf club according to claim 1, wherein the shaft has a shaft weight Ws that is equal to or less than 0.070 kg.

4. The golf club according to claim 1, wherein a shaft weight Ws is equal to or greater than 50 g.

5. The golf club according to claim 1, wherein a shaft weight Ws is equal to or greater than 52 g.

6. The golf club according to claim 1, wherein a shaft weight Ws is equal to or greater than 54 g.

* * * * *